US011259655B1

(12) United States Patent
Humphries

(10) Patent No.: US 11,259,655 B1
(45) Date of Patent: Mar. 1, 2022

(54) WALL MOUNTABLE WIG RACK

(71) Applicant: Qwinassau Humphries, Birmingham, AL (US)

(72) Inventor: Qwinassau Humphries, Birmingham, AL (US)

( * ) Notice: Subject to any disclaimer, the term of this patent is extended or adjusted under 35 U.S.C. 154(b) by 0 days.

(21) Appl. No.: 17/145,463

(22) Filed: Jan. 11, 2021

(51) Int. Cl.
*A47F 7/06* (2006.01)
*A45D 44/14* (2006.01)
*A47F 5/08* (2006.01)

(52) U.S. Cl.
CPC ..... *A47F 7/065* (2013.01); *A45D 44/14* (2013.01); *A47F 5/08* (2013.01)

(58) Field of Classification Search
CPC .... A47F 7/065; A47F 7/06; A47F 7/12; A47F 5/08; A47F 5/0876; A45D 44/14; A47G 25/74; A47G 25/746; A47B 2230/0029; A47B 2230/0037
USPC ..... 211/13.1, 87.01, 30, 32, 33, 85.5, 100
See application file for complete search history.

(56) References Cited

U.S. PATENT DOCUMENTS 577,010 A * 2/1897 Cundey ..... A47G 25/10 211/32
821,364 A * 5/1906 Jessel ..... A47G 25/0657 211/89.01
828,435 A * 8/1906 Stansbury ..... A47G 25/0657 211/89.01
1,254,508 A * 1/1918 Kellar ..... A47F 5/01 211/106
1,557,989 A * 10/1925 Dombrowsky ..... A47G 25/746 211/85.3
1,926,201 A * 9/1933 Kahns ..... A47G 25/0607 211/32
1,984,827 A * 12/1934 Derman ..... A47B 96/16 312/4
2,006,033 A * 6/1935 Sharpe ..... A47G 25/10 211/32
2,015,620 A * 9/1935 Cuthbert ..... A47G 25/746 211/96
D118,029 S * 12/1939 Webb ..... D6/682.6
D151,372 S * 10/1948 Keefer ..... D6/317
2,474,436 A * 6/1949 Pestyner ..... A47G 25/746 211/104
D164,653 S * 9/1951 Steib ..... D6/320
2,600,916 A * 6/1952 Pestyner ..... A47G 25/746 211/105
2,615,579 A * 10/1952 Sampson ..... A47G 25/746 211/100
2,642,194 A * 6/1953 Boltauzer ..... A47G 25/746 211/104
2,707,564 A * 5/1955 Smith ..... A47G 25/10 211/32

(Continued)

*Primary Examiner* — Jennifer E. Novosad

(57) ABSTRACT

A one-piece wall mountable wig holder comprising of a long back wall plate with multiple protruding extensions for the wig head to sit onto a dowel. The unit is configured to accommodate multiple heads and attach to the wall thus eliminating the need of occupying floor space and installing additional racks. In an embodiment of the present invention, the long back wall plate has pair of holes drilled for hanging the wig holder on a wall. The long back wall plate has plurality of holes for screwing and attaching the protruding extensions that support the dummy wig head. The protruding extensions have dowels affixed on their surface on which dummy wig heads can be kept.

1 Claim, 3 Drawing Sheets

(56) References Cited

U.S. PATENT DOCUMENTS 3,162,413 A * 12/1964 Hexdall ..... F16L 3/00 248/71
3,563,528 A 2/1971 Campo et al.
3,591,118 A * 7/1971 Gentile ..... A45D 44/14 248/231.71
3,602,372 A * 8/1971 Verrecchio ..... A47F 7/065 211/100
3,603,322 A * 9/1971 Wilson ..... A45C 11/00 132/315
3,653,563 A 4/1972 Russ et al.
3,658,283 A 4/1972 Martin et al.
3,740,013 A * 6/1973 Bentley ..... F16M 13/02 223/66
D229,267 S * 11/1973 Brown ..... D6/682.6
3,820,694 A * 6/1974 Pabis ..... A47F 5/04 223/66
3,828,588 A * 8/1974 Duncan ..... B05B 13/0421 68/5 C
D236,567 S * 9/1975 Ballin ..... D6/323
3,938,667 A * 2/1976 Buckland ..... A47G 25/746 211/87.01
4,068,761 A * 1/1978 McCarthy ..... A47G 7/045 211/134
4,403,703 A * 9/1983 Nikles, Jr. ..... A47F 7/24 211/193
D291,154 S * 8/1987 Owen ..... D6/317
D304,793 S * 11/1989 Burke ..... D6/569
D306,385 S * 3/1990 Alexander ..... D6/552
4,993,557 A * 2/1991 Davis ..... A47F 7/06 211/30
D338,147 S * 8/1993 Gordin ..... D8/71
5,285,906 A * 2/1994 Wisnowski ..... A63C 11/028 211/62
5,295,588 A * 3/1994 Neirinckx ..... A47G 25/10 211/30
5,333,743 A * 8/1994 Loewke ..... A47G 25/0678 211/106.01
D351,745 S * 10/1994 Seifert ..... D6/682.6
5,425,463 A * 6/1995 Toscanini ..... A47G 25/746 211/104
5,503,312 A * 4/1996 Kassner ..... A47F 7/065 211/182
5,642,819 A * 7/1997 Ronia ..... A47G 33/04 211/86.01
D398,160 S * 9/1998 Umbarger ..... D6/320
5,813,550 A * 9/1998 Sheehan ..... A47F 5/0807 211/87.01
6,112,909 A * 9/2000 Moseley ..... A47F 5/0807 211/30
6,892,894 B2 * 5/2005 Aiken ..... A47F 7/06 211/30
D624,332 S * 9/2010 Nwatu ..... D6/681.3
D649,714 S * 11/2011 Key ..... D28/93
D668,888 S * 10/2012 Key ..... D6/671
8,439,210 B1 * 5/2013 Griffith ..... A47G 25/0614 211/119.004
D702,964 S * 4/2014 Sterling ..... D6/514
D719,769 S * 12/2014 Daniels ..... D6/682.1
8,950,591 B1 * 2/2015 McDowell ..... A45D 44/14 211/13.1
D775,476 S * 1/2017 Corless ..... D6/320
9,538,831 B1 * 1/2017 Tracy ..... A47F 7/06
9,629,485 B2 * 4/2017 Florek ..... A47G 33/004
10,219,605 B1 * 3/2019 Love ..... A47B 96/1483
D907,298 S * 1/2021 Williams ..... D28/93
2005/0194334 A1 * 9/2005 Johnson ..... A45D 8/36 211/85.2
2007/0131631 A1 * 6/2007 Dewey ..... A47F 5/0815 211/59.1
2007/0193967 A1 * 8/2007 Ryan ..... A63B 71/0036 211/70.5
2009/0283486 A1 * 11/2009 Reason-Kerkhoff ..... A63B 71/0045 211/85.7
2010/0066222 A1 * 3/2010 Ito ..... A47B 61/04 312/326
2015/0129455 A1 * 5/2015 Williams ..... A45C 11/00 206/526
2015/0230589 A1 * 8/2015 Davidson ..... A41G 3/0041 223/66
2016/0061354 A1 * 3/2016 Abby ..... B65H 75/446 211/85.5
2016/0076695 A1 * 3/2016 Henington ..... F16B 45/00 132/53
2021/0112948 A1 * 4/2021 Wachtfogel ..... A45D 44/14

* cited by examiner

WALL MOUNTABLE WIG RACK

FIELD OF THE INVENTION

The present invention generally relates to a wig holder and more particularly to a hanging wig rack with multiple extensions protruding for the wig head to sit unto a dowel.

BACKGROUND OF THE INVENTION

The present invention is a wall mountable multiple wig holder comprising a long back wall plate with holes configured to attach multiple extensions protruding for accommodating wig head to sit unto a dowel.

In an embodiment of the present invention, the wig holding rack is designed to hang on wall and has multiple protrusions each able to accommodate a dummy head, thus offering both storage and inventory display abilities while preventing tangling of the wig hairs. Wigs often get tangled, matted, or even dirty when not stored properly thus requiring more grooming and maintenance. Some people group them together in a storage drawer, closet, or bag as a result they end up detangling them each time they wish to wear the wig. A wig head sitting on a piece of a furniture or on the floor does not work effectively for long hair wigs because the hair length and weight of the hair make the wig head slip and fall over again and again. All of these problems lead to losing of the wig hair thus requiring the need to cut mangled hair and the wig lose style in the process of washing and cutting mangled hair. There are specialized wigs that are expensive for their use by person suffering from alopecia, cancer, hereditary hair loss and many other purposes including hair protection styling, work, team appearances, new looks or even fun.

Over the time the wigs have become increasingly common, but the storage solutions are not. The present invention offers a hanging wig rack that solves the problem of both storing the wig and displaying them as inventory at the same time without requiring any floor space.

Several prior attempts to deal with such problems have been utilized as set forth below:

U.S. Pat. No. 3,658,283A discloses a rack device for supporting a wig; which includes a base plate from which a lower shaft extends in one direction for receiving an upper shaft therein, and from which a plurality of stub shafts extend in the opposite direction to provide support therefor; said device further including a tapered spindle mounted on an angular extension of the upper shaft; which has an adjustment for the upper shaft for varying the amount of extension and rotation with the lower shaft; and which has an adjustment for the tapered spindle for varying the amount of rotation with the angular extension of the upper shaft.

Japanese Patent Publication No. JP3117707U discloses a holder for holding a wig when the wig is mounted and dried, and can also be used as a holder for storing a wig. A holder body having a curved surface that can be attached to the back side of a wig to hold the wig, and is sized to be housed in a wig case together with the wig while holding the wig. A holder body mounting portion that can be detachably attached to the holder body, and a holder that is provided on the opposite side of the holder body mounting portion and that can be detachably fixed to the ground surface It consists of an attachment.

U.S. Pat. No. 3,653,563A discloses a wig holder for mounting on a table and in a wig box. The holder simulates a head and neck and has a plastic housing assembly secured to it which slidingly receives a rack assembly and a plunger assembly. The housing assembly has a vertically extending tube integrally joined to a horizontally extending tube. A top plate is secured to the bottom of the vertical tube. A rack is mounted on top of a bottom plate, and is positioned in the vertically extending tube. A plunger is slidable in the horizontal tube, engaging and locking the rack in position. A handled rod is mounted to the plunger. A hole is provided through the top and bottom plates for mounting the holder in a wig box.

Japanese Patent Publication No. JP3161054U discloses an assembly-type wig holder that requires a small volume when storing and transporting an instrument that holds a wig or the like is provided. A wig holder for holding a wig for display is made of a relatively light and hard paper, acrylic or plastic having a head-shaped, round, or semi-circular and planar shape with a cut. It consists of members 1 to n. A wig holder is formed by inserting members into the notch, and when the wig holder is not used, the members can be detached from each other to form a portable wig display device.

U.S. Pat. No. 3,563,528A discloses a mechanical wig holder comprising a housing carried in a head form and having catch means pivotably mounted therein, and control means for controlling the movement of the catch means between an operative and an inoperative position.

All of the above prior art references disclose wig holders with complex shapes and not so easy to use mechanisms. Additionally, many of them are not suitable to be use in small spaces when many wigs have to be assorted and stored in a manner that they don't tangle and also offer inventory display facility.

The present invention disclosed here offers a wall mountable multiple wig holder wherein the dummy wig head sits onto a dowel thus offering a storage and display rack without taking any floor space.

BRIEF SUMMARY OF THE INVENTION

The present invention is a one-piece wall mountable wig holder comprising a long back wall plate with multiple protruding extensions for the wig head to sit onto a dowel. The unit is configured to accommodate multiple heads and attach to the wall thus eliminating the need of occupying floor space and installing additional racks.

In an embodiment of the present invention, the long back wall plate has a pair of holes drilled for hanging the wig holder on wall. The long back wall plate has plurality of holes for screwing and attaching the protruding extensions that support the dummy wig head. The protruding extensions have dowels affixed on their surface on which dummy wig heads can be kept.

It is an objective of the present invention to provide a hanging wig rack that can be screwed onto the wall.

It is an objective of the present invention to solve the problem of accommodating the shorter as well as longer wigs.

In an embodiment of the present invention, the protruding extensions and dowel upon which the head sits are narrow enough so that the long hair drapes hang freely between through the rack which as a result prevents bunching or tangling of the wigs.

It is an object of the present invention, to solve the problem of storing wigs in an organized manner by providing hanging wig rack which can be set on wall at any height as per user's preferences.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Other objects, advantages, and novel features of the invention will become more apparent from the following detailed description when taken in conjunction with the accompanying drawings.

BRIEF DESCRIPTION OF THE SEVERAL VIEWS OF THE DRAWINGS

These and further features and advantages of the invention will become more clearly understood in the light of the ensuing description of a preferred embodiment thereof, given by way of example only, with reference to the accompanying drawing wherein.

DETAILED DESCRIPTION OF THE INVENTION

The object of the present invention is to provide a wall mountable wig holding rack.

Additional features and advantages of the invention will be set forth in the description which follows, and in part will be obvious from the description, or may be learned by the practice of the invention. These and other features of the present invention will become more fully apparent from the following description, or may be learned by the practice of the invention as set forth hereinafter.

Figure 1:
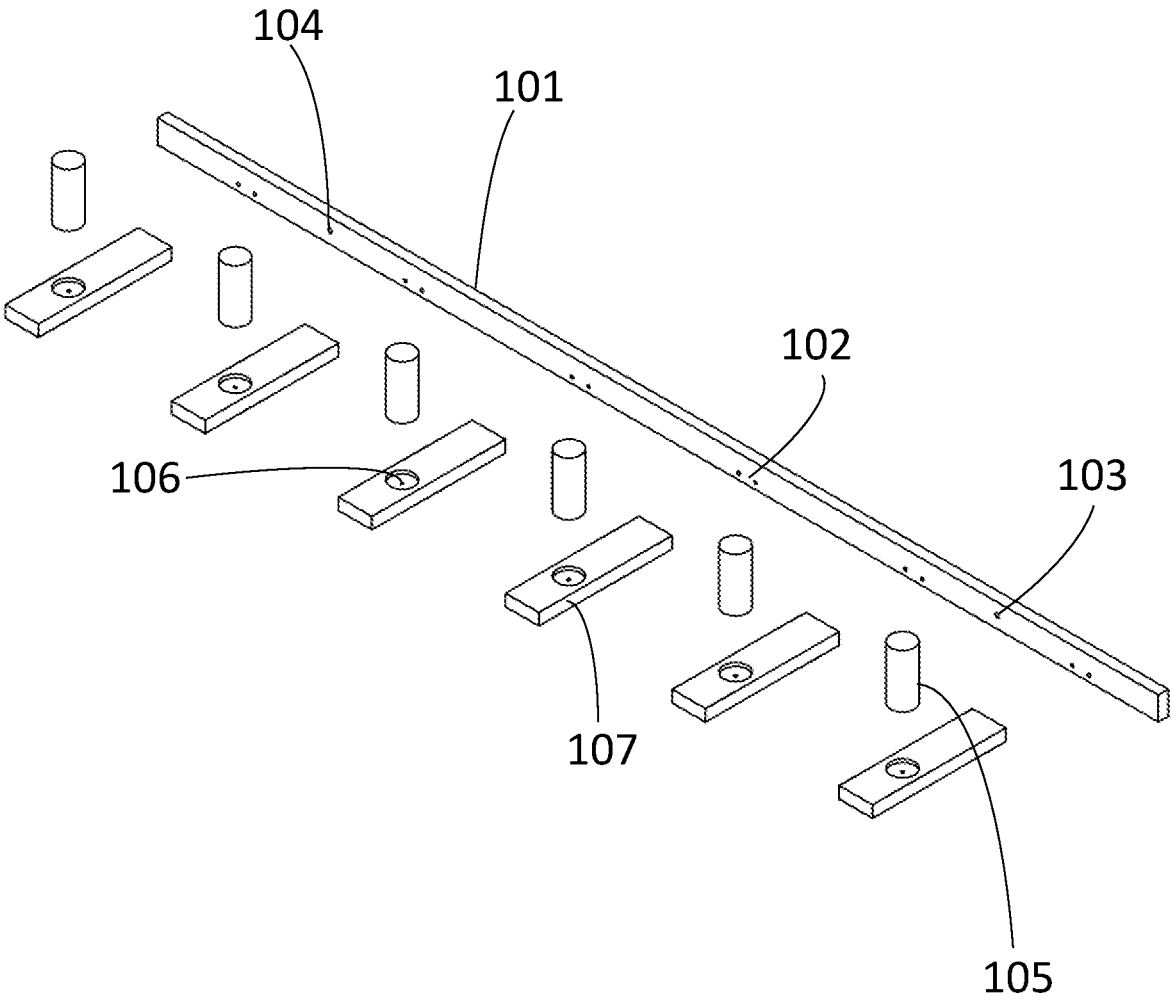
FIG. 1 is an exploded embodiment of the wig holding rack.
Figure 2:
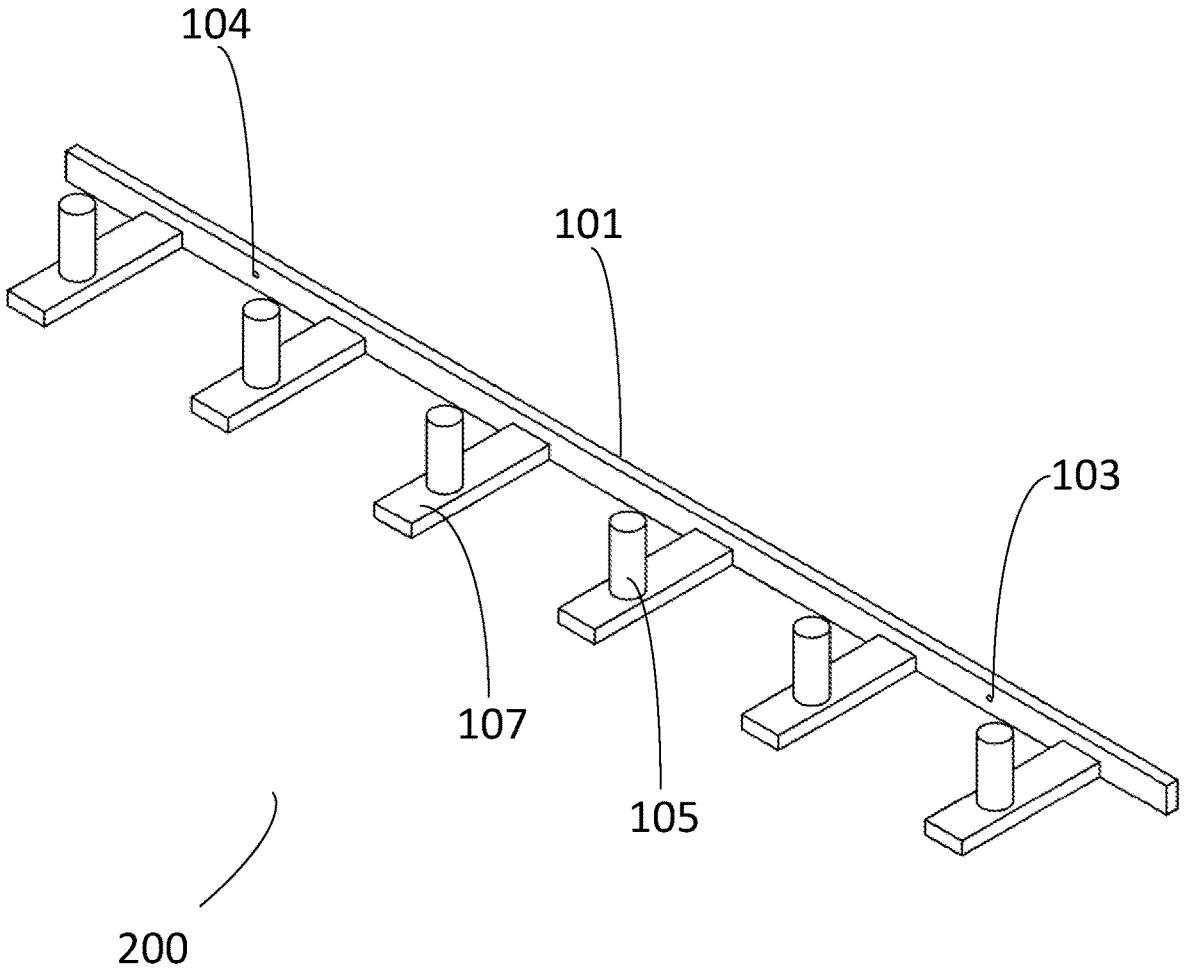
FIG. 2 is an exemplary embodiment of the wig holding rack.
Figure 3:
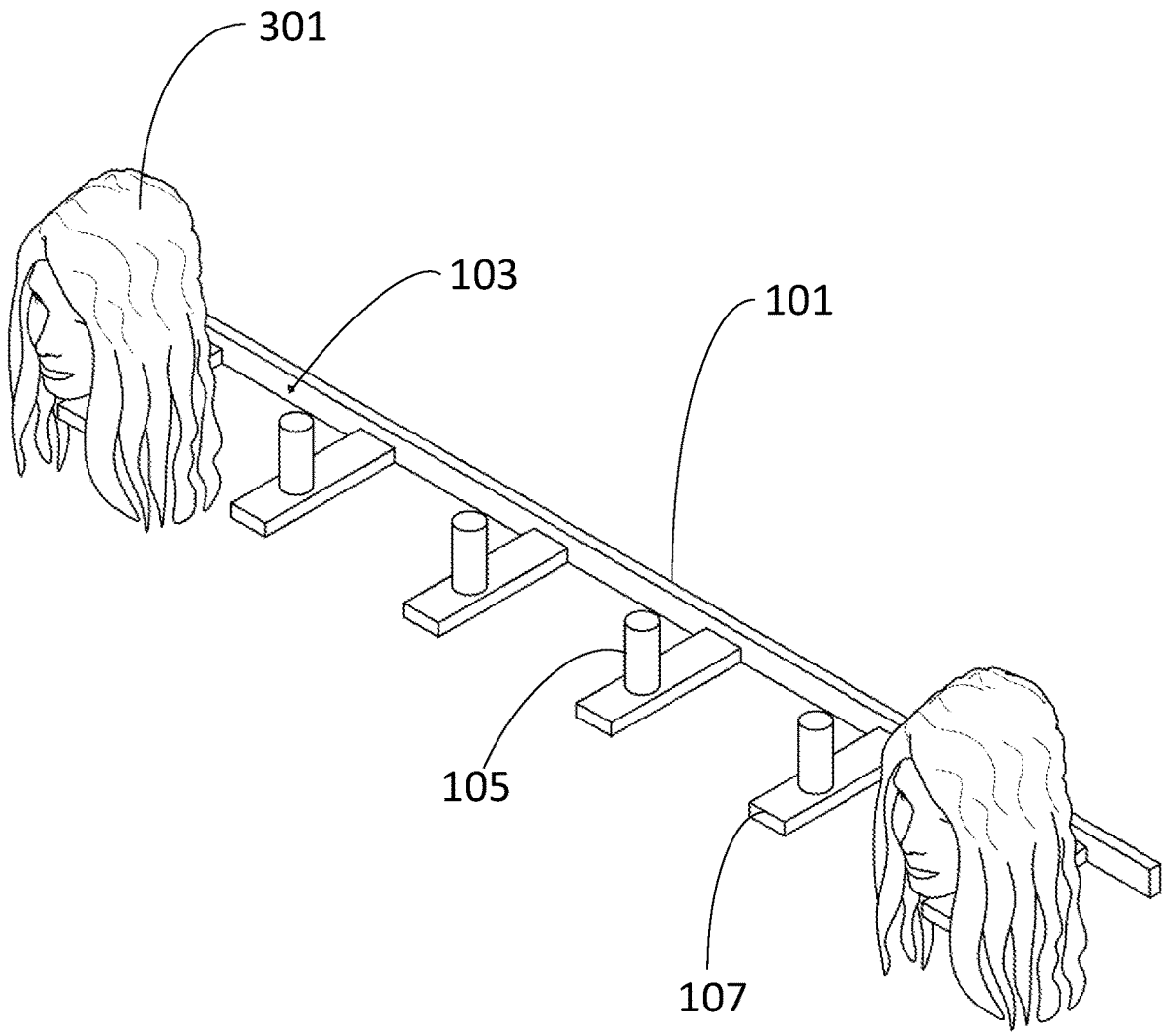
FIG. 3 is an exemplary embodiment of the wig rack supporting dummy wig heads onto its dowels.

With reference now to the drawings, and in particular to FIG. 1 to FIG. 3 thereof, a wall mountable wig holding rack embodying the principles and concepts of the present invention is described.

FIG. 1 illustrates an unassembled embodiment of the wig holding rack wherein the long back wall plate 101 has wall mounting hole 103 and hole 104 drilled in it on the ends for mounting wig holding rack on the wall. The protrusion mounting holes 102 are drilled to screw and attach protrusions 107 onto the long back wall plate 101 hung on the wall. The protrusion 107 has a dowel mounting hole 106 in it to screw and mount dowel 105 upon it which supports the dummy wig heads (as shown in FIG. 3) mounted on it.

In an embodiment of the present invention, the long back wall plate 101 has multiple protrusions 107 with each having a dowel mounted upon them to support dummy wig heads.

FIG. 2 illustrates an exemplary embodiment of the present invention wherein the wig holding rack 200 is in assembled final state ready for hanging onto the wall. In an embodiment of the present invention, the wig holding rack 200 can be anchored onto the wall by tightening screw at the holes 103 and 104.

In an embodiment of the present invention, the wig holding rack 200 comprise of lock back wall plate 101 having plurality of protrusions or extensions 107 attached to it. Each protrusion or extension 107 has dowel 105 attached vertically onto its surface which act as a support for holding dummy wig heads 301 (as shown in FIG. 3).

FIG. 3 illustrates an embodiment of the present invention wherein the wig holding rack is supporting dummy wig heads 301 hanging upon its dowels 105.

In an embodiment of the present invention, the long back wall plate 101 that attaches to the wall is a rectangular board of dimensions approximately forty-eight inches length, one and a half inches breadth and one inch thick.

The dimension of the protrusion or extension 107 attached to the long back wall plate is substantially seven-inch length, one-and-a-half-inch breadth and one-inch thick.

The dimensions of the dowel 105 mounted on the top of protrusion are two and a half-inch length and one-inch diameter.

In an embodiment of the present invention the long back wall plate 101 has two holes that screws and anchor the plate onto the wall. The long back wall plate has plurality of extensions attached to it that act as support for the dummy wig heads.

Based on the above, it would be apparent that the present invention offers significant advantages—including capability of wall mounting the wig holding rack, eliminating the need of installing additional rack or shelving system and offering an apparatus that at the same time act as storage and display shelve for the wigs without occupying any floor space. Additionally, this design can accommodate the long wigs as well as the short one even in the smallest places and the protrusions are narrow so that the long hair drapes freely between through the rack thus preventing bunching or tangling of the wig hairs.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention as defined by the appended claims. Additionally, the invention illustratively disclose herein suitably may be practiced in the absence of any element which is not specifically disclosed herein—and in a particular embodiment that is specifically contemplated, the invention is intended to be practiced in the absence of any one or more element which are not specifically disclosed herein.

The invention claimed is:

1. A wall mountable rack for holding a plurality of wigs, the rack comprising:

an elongated horizontally extending back wall plate defining a first axis along a length thereof, including a front surface and a rear surface that is parallel to the front surface and a depth defined therebetween, a plurality of mounting holes and a plurality of tightening screws extending therethrough for mounting the plate to the wall such that the back wall plate is adapted to be disposed flush against the wall, whereby the mounting holes extend through the depth of the plate, and a plurality of protrusion mounting holes extending through the depth of the plate;

a plurality of horizontally extending protrusions each defining a second axis along a length thereof, the plurality of protrusions defining a first quantity, whereby the second axis is perpendicular to the first axis, each of said protrusions including a top surface and a bottom surface that is parallel to the top surface, and first and second sides that are parallel to one another and defining a width therebetween, each of said protrusions attached to the back wall plate by a plurality of fasteners extending through the protrusion mounting holes and into a proximal end of each of the protrusions such that the plurality of protrusions are cantilevered from the front surface of the back wall plate, each of said protrusions having a dowel mounting hole at a free distal end thereof, whereby a first width is defined between the second side of one of the plurality of protrusions and the first side of an adjacent one of the plurality of protrusions, and the first width between adjacent protrusions is the same;

a plurality of dowels each defining a third axis along a length thereof, the plurality of dowels defining a second quantity that is equal to the first quantity, whereby the third axis is perpendicular to the first axis and the second axis, one of the plurality of dowels is mounted to the distal end of each of the protrusions by a fastener extending through the respective dowel mounting hole and into a bottom of the respective dowel such that the plurality of dowels remain stationary, and each of the third axes of the dowels are parallel to one another;

a plurality of dummy wig heads each defining a fourth axis along a length thereof and a second width perpendicular to the fourth axis, the second width being greater than the first width, the plurality of dummy wig heads defining a third quantity that is equal to the first quantity and the second quantity, whereby the fourth axis is parallel to the third axis and perpendicular to the first axis and the second axis, each of the dummy wig heads is mounted on each of the plurality of dowels and each of the fourth axes of the dummy wig heads are parallel to one another, wherein a wig comprising hair is adapted to be held upon each of the dummy wig heads, such that the hair of a first one of the wigs is prevented from bunching or tangling with the hair of an adjacent one of the wigs, and the plurality of dowels and the plurality of dummy wig heads are located entirely in front of the front surface of the back wall plate.

* * * * *